US005302095A

United States Patent [19]

Richardson, Jr.

[11] Patent Number: 5,302,095

[45] Date of Patent: Apr. 12, 1994

[54] ORBITING ROTARY COMPRESSOR WITH ORBITING PISTON AXIAL AND RADIAL COMPLIANCE

[75] Inventor: Hubert Richardson, Jr., Brooklyn, Mich.

[73] Assignee: Tecumseh Products Company, Tecumseh, Mich.

[21] Appl. No.: 930,481

[22] Filed: Aug. 14, 1992

Related U.S. Application Data

[63] Continuation of Ser. No. 692,140, Apr. 26, 1991, abandoned.

[51] Int. Cl.[5] ..... F04C 18/356; F04C 23/00

[52] U.S. Cl. ..... 418/57; 418/59; 418/63

[58] Field of Search ..... 418/57, 59, 63

[56] References Cited

U.S. PATENT DOCUMENTS

| | | | |
|---|---|---|---|
| 300,629 | 6/1884 | Nash . | |
| 353,703 | 12/1886 | Nash . | |
| 433,088 | 7/1890 | Nash . | |
| 910,175 | 1/1909 | Cole . | |
| 1,683,390 | 9/1928 | Kagi . | |
| 1,780,109 | 10/1930 | Berglund | 418/57 |
| 1,906,142 | 4/1933 | Ekelof | 418/57 |
| 1,973,670 | 9/1934 | Star . | |
| 2,100,014 | 11/1937 | McCracken . | |
| 2,187,730 | 1/1940 | Davidson . | |
| 2,423,507 | 7/1947 | Lawton . | |
| 2,859,911 | 11/1958 | Reitter . | |
| 2,965,288 | 12/1960 | Butler . | |
| 3,125,031 | 3/1964 | Rydberg et al. | 418/59 |
| 3,463,091 | 8/1969 | Delsuc | 418/57 |
| 3,563,678 | 2/1971 | Sadler | 418/6 |
| 3,909,161 | 9/1975 | Stenner | 418/6 |
| 3,977,369 | 8/1976 | Spark et al. | 123/8.43 |
| 4,005,951 | 2/1977 | Swinkels | 418/59 |
| 4,086,039 | 4/1978 | Ettridge | 418/61.1 |
| 4,235,572 | 11/1980 | Winkler et al. | 418/60 |
| 4,406,600 | 9/1983 | Terauchi et al. | 418/55.3 |
| 4,637,786 | 1/1987 | Matoba et al. | 418/94 |
| 4,810,176 | 3/1989 | Suefuji et al. | 418/55.3 |
| 4,884,955 | 12/1989 | Richardson, Jr. | 418/57 |

FOREIGN PATENT DOCUMENTS

| | | | |
|---|---|---|---|
| 117971 | 12/1943 | Australia | 418/57 |
| 363366 | 11/1922 | Fed. Rep. of Germany | 418/59 |
| 536786 | 10/1931 | Fed. Rep. of Germany | 418/57 |
| 3536714 | 10/1984 | Fed. Rep. of Germany . | |
| 582267 | 10/1924 | France | 418/57 |
| 755955 | 9/1933 | France | 418/63 |
| 57-70990 | 5/1982 | Japan | 418/63 |
| 61-11488 | 1/1986 | Japan . | |
| 358464 | 4/1930 | United Kingdom | 418/59 |

*Primary Examiner*—John J. Vrablik
*Attorney, Agent, or Firm*—Baker & Daniels

[57] ABSTRACT

An orbiting rotary-type compressor including an orbiting cylindrical piston member, sealing members, cylinder housing, Oldham ring assembly and motor for permitting orbital movement. Sealing is achieved sliding vanes within slots in the cylinder housing which are sealingly biased toward orbiting piston member by means of springs. An axial compliance and a radial compliance mechanism promotes proper sealing.

24 Claims, 5 Drawing Sheets

ORBITING ROTARY COMPRESSOR WITH ORBITING PISTON AXIAL AND RADIAL COMPLIANCE

This is a continuation of application Ser. No. 07/692,140, filed Apr. 26, 1991, now abandoned.

BACKGROUND OF THE INVENTION

The present invention generally relates to refrigeration compressors and, more particularly, to such compressors having an orbiting piston member, wherein it is possible to provide an axial and radial compliance force on the orbiting piston member to bias it toward the compressor cylinder walls for proper sealing.

A typical rotary compressor comprises a rotating piston member or roller and a cylinder housing, wherein the rotation of the roller compresses refrigerant fluid. Rotary compressors have advantages over other types of compressors by virtue of their high efficiency, small size, and low cost. Disadvantages of rotary compressors lie in the necessity of close tolerances between the piston and cylinder walls and the high costs of manufacturing parts with such close tolerances.

Scroll compressors employ two opposing involutes one stationary and one orbiting to compress fluid. The sealing mechanism of scroll type compressors includes structures for axial and radial compliance of the scroll members. An advantage of scroll compressors over rotary compressors is that friction between moving parts is decreased since the scrolls are not rotating. Particular disadvantages of scroll compressors are the long machining times for end milling the scroll wraps and the requirement for very close tolerances between the scroll wraps. These requirements make the scrolls very expensive to manufacture. An example of a scroll compressor is found in U.S. Pat. No. 4,875,838 assigned to the assignee of the present invention and incorporated herein by reference.

It is known in the field of compressors to use an orbiting piston member to compress fluid. The disadvantages of these are the complex mechanisms used to create the orbiting motion. In one prior art example of an orbiting piston compressor, it is known to use a conventional Oldham ring assembly to prevent rotation, but there were no means for achieving axial and radial compliance of the orbiting piston within the cylinder housing.

The present invention is directed to overcoming the aforementioned disadvantages wherein it is desired to provide an axial force and radial force upon the orbiting cylindrical piston to facilitate sealing and prevent leakage between the cylindrical piston and cylinder housing.

SUMMARY OF THE INVENTION

The present invention overcomes the disadvantages of above described prior art compressors, by providing axial compliance and radial compliance, to resist the tendency of the orbiting piston to separate both axially and radially during compressor operation. The use of a cylindrical piston member makes the compressor easy to manufacture. The orbiting rotation of the cylindrical piston reduces friction between metal to metal contact surfaces within the compressor.

Generally the present invention provides a compressor comprising a cylinder and a cylindrical piston. The piston is caused to orbit by means of an Oldham ring disposed between the piston and drive mechanism. A swing link assembly connected to the drive causes the orbiting piston to radially comply with the cylinder. Axial compliance between the piston and cylinder is accomplished by suction and discharge pressure regions inside the compressor housing.

More specifically, the invention provides, in one form thereof, an annular piston orbiting within the cylinder. This orbiting piston mounted on an orbiting plate creates an additional pocket for the compression of refrigerant.

In one aspect of the invention, two vanes, slidable in radial slots in the cylinder housing, cause sealing of the compression chambers and separation between suction and discharge pressure sections.

In an alternative embodiment, there is a single slidable vane, through the annular orbiting piston, which separates the compression chambers into suction and discharge pressure sections. The slidable vane slides against an area of the cylinder walls that has a specific radius to prevent seizing.

In another alternative embodiment, the orbiting piston member is not annular, but solid, and orbits within a cylinder without a fixed center section. This configuration creates a single compression chamber which can be separated by a single vane into suction and discharge pressure sections.

A advantage of the instant invention is the capacity for radial compliance of the piston along the cylinder side walls. This enhances sealing and improves pumping ratios.

A further advantage of scroll compressors is that the present invention minimizes overturning moments on the orbiting piston and allows for a more stable compressor.

Yet another advantage of the compressor of the present invention is that axial compliance of the orbiting member toward the fixed member is accomplished effectively without excessive leakage between the discharge pressure region and suction pressure region of the compressor.

Another advantage of the present invention is the provision of a simple, reliable, inexpensive, and easily manufactured compressor.

DESCRIPTION OF THE PREFERRED EMBODIMENT

Figure 1:
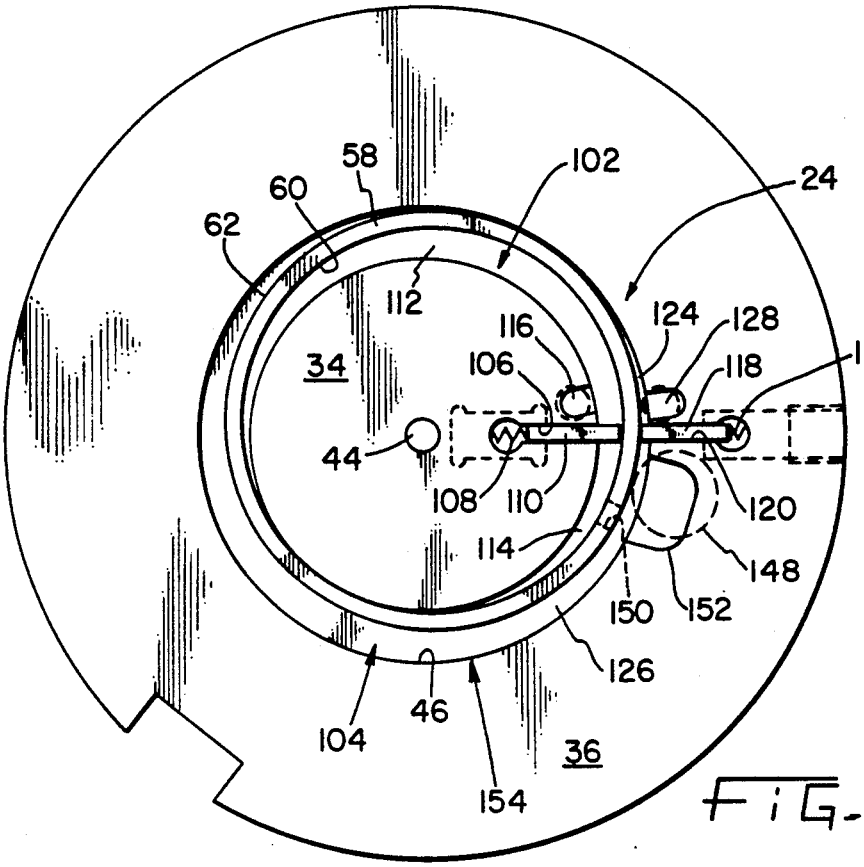
FIG. 1 is a transverse cross-sectional view showing the compressor of the present invention.
Figure 3:
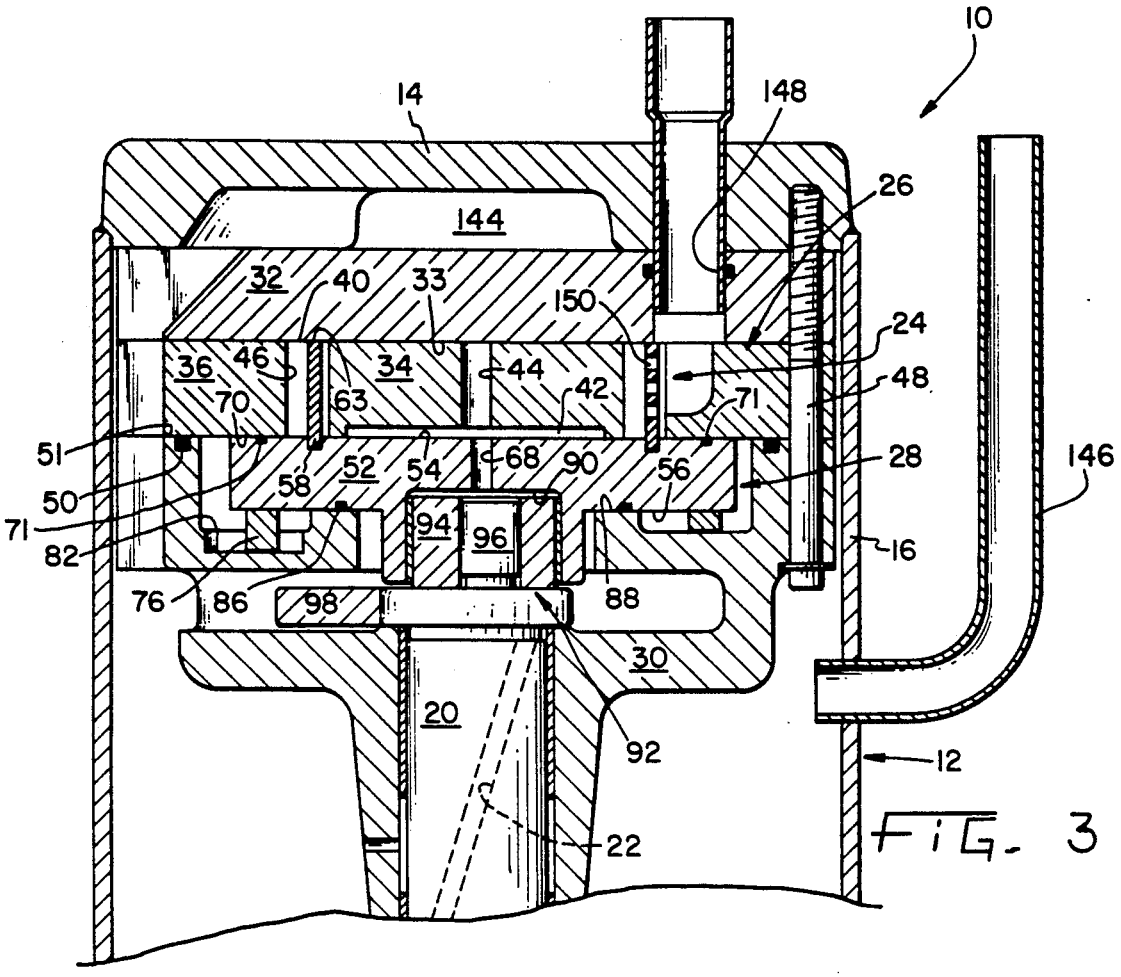
FIG. 3 is a fragmentary longitudinal sectional view of the compressor of the present invention.

Referring now to FIGS. 1 and 3, there is shown a hermetically sealed compressor 10 having a housing 12. The housing 12 has a top cover plate 14, a central portion 16, and a bottom portion (not shown). Within hermetically sealed housing 12 is an electric motor (not shown) that provides the power to turn crankshaft 20. Crankshaft 20 is of conventional construction including an axial oil passageway 22 to allow passage of lubricating oil from an oil sump (not shown) to compressor mechanism 24.

A compressor mechanism 24 is enclosed within housing 12 and generally comprises a cylinder housing assembly 26, an orbiting piston assembly 28 and a main bearing frame member 30. As shown in FIG. 3, the cylinder housing assembly 26 includes a top member 32, having an end wall 33, to which is fastened a generally circular center cylinder member 34, and an annular outer cylinder member 36, by means of screws 38. Between fixed center cylinder member 34 and annular fixed outer cylinder member 36, there is an annular compression space 40 where the orbiting piston assembly 28 interfits. Fixed center cylinder member 34 has a recessed bottom portion 42 and void 44 which functions as an oil reservoir for orbiting piston assembly 28. Annular fixed outer cylinder member 36 has an inner wall 46 that defines the walls of the compression chamber. Fixed cylinder housing assembly 26 is fastened by means of a plurality of screws 48 to top cover 14. An annular seal element 50 is disposed between fixed outer cylinder member 36 and the top surface 51 of main bearing frame member 30 to seal against discharge pressure.

Figure 6:
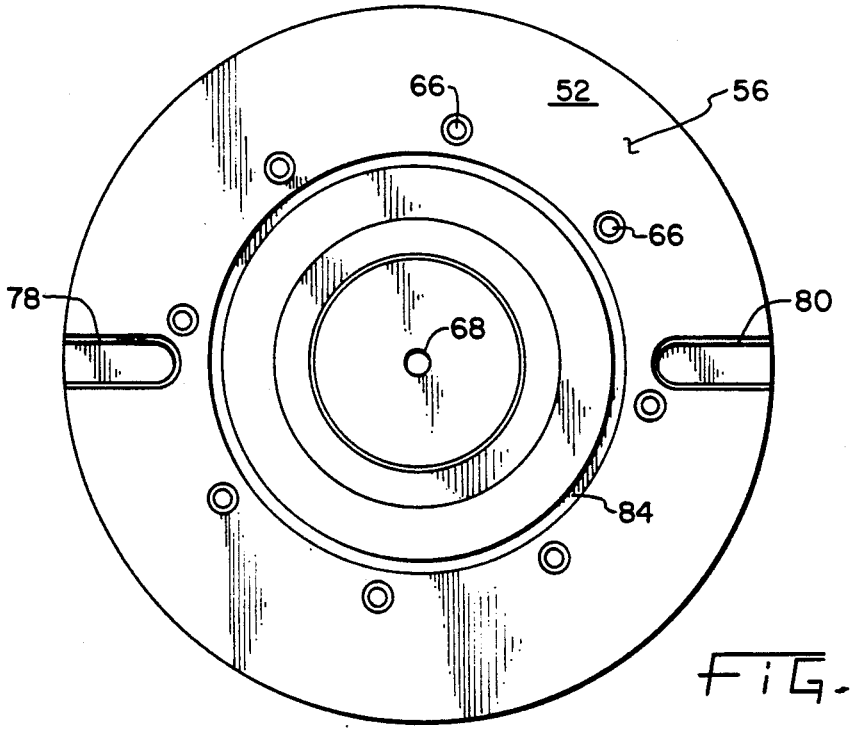
FIG. 6 is a top plan view of the fixed cylinder housing.
Figure 7:
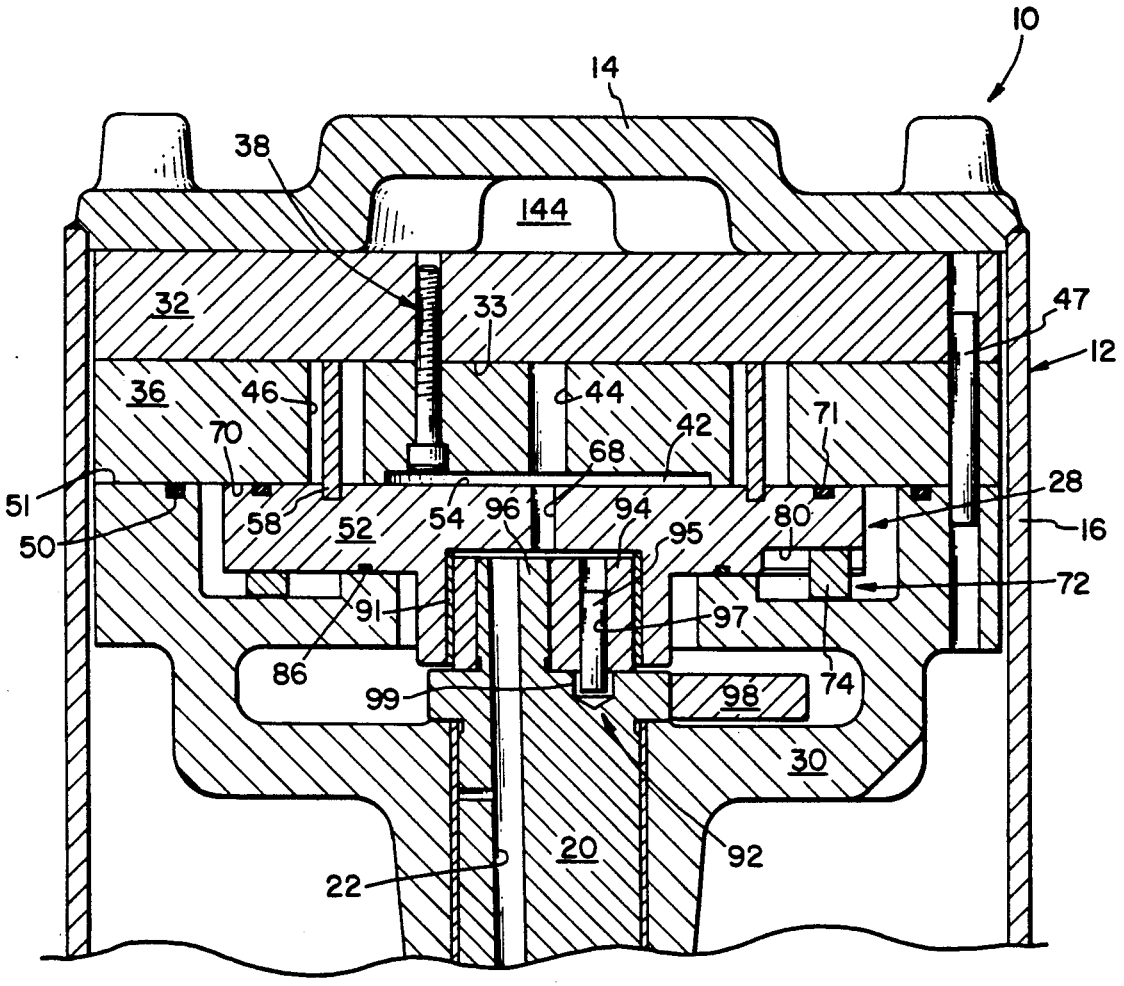
FIG. 7 is a fragmentary longitudinal sectional view of the compressor of FIG. 1.

The orbiting piston assembly 28 includes a generally flat orbiting plate 52 having a mounting surface 54 and a drive surface 56. Annular orbiting piston member 58 has an inside wall 60, outside wall 62, and end face 63. Annular orbiting piston member 58 is fastened into a annular groove 64 in mounting surface 54 of the orbiting plate 52 by a plurality of screws 66, as shown in FIG. 6, although it could be connected by welding, brazing, or integrally formed on orbiting plate 52. An axial oil passageway 68 extends through orbiting plate 52 allowing oil flow between the axial oil passage 22 in crankshaft 20 and void 44 in fixed center cylinder member 34. A radial oil passageway (not shown), within orbiting plate 52 permits oil flow to the mounting surface 54 radially outside of orbiting piston member 58. The orbiting annular piston 58 is interfit into the space 40 between the fixed center cylinder member 34 and fixed outer cylinder member 36. Orbiting plate 52 is larger than the annular opening 40 in fixed outer cylinder member 36 and slides on bottom surface 70 of fixed outer cylinder member 36. An annular seal 71 is operably interfit between bottom surface 70 of fixed outer cylinder member 36 and orbiting plate 52 to seal between discharge pressure and suction pressure regions.

Figure 5:
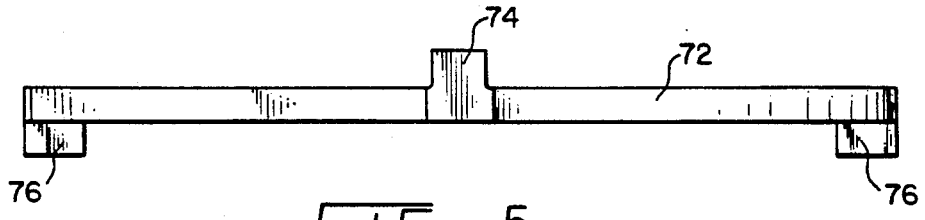
FIG. 5 is a side elevational view of the Oldham ring.

An Oldham ring 72 is intermediate the orbiting plate 52 and the main bearing frame member 30. As shown in FIG. 5, Oldham ring 72 is of conventional construction with two pairs of keys 74, and 76. Upwardly facing key pair 74 interfit and slide within grooves 78 and 80 in drive surface 56 of orbiting plate 52. Downwardly facing key pair 76 slide and interfit within groove 82 in main bearing member 30. Oldham ring 72 prevents the orbiting piston assembly 28 from rotating about its own axis.

FIG. 6 shows annular groove 84 where an annular seal element 86 is disposed to seal between orbiting plate 52 and thrust surface 88 of main bearing frame member 30. The drive surface 56 of orbiting plate 52 forms a hub 90 into which crank mechanism 92 connected to crankshaft 20 is received. The crank mechanism 92 is a conventional swing link assembly including a cylindrical roller 94 and an eccentric crank pin 96, whereby roller 94 is eccentrically journalled about eccentric crank pin 96. Roller 94 is journalled for rotation within hub 90 by means of sleeve bearing 91, which is press fit into hub 90. Sleeve bearing 91 is preferably a steel backed bronze bushing. Further, hollow roll pin 95 is press fit into bore 97 of roller 94 and extends into pocket 99 crankshaft 20 so that roller 94 is restrained from pivoting completely about crankpin 96. This restraint against pivoting is used primarily during assembly to keep roller 94 within a range of positions to assure easy assembly. Below this crank mechanism 92 is a counterweight 98 attached to crankshaft 20.

The interfitting of the orbiting piston member 58 within the space between the fixed center cylinder member 34 and inner wall 46 of fixed outer cylinder member 36 creates an inner pocket 102 and outer pocket 104 that compress refrigerant when the orbiting piston member 58 is orbited.

As shown in FIG. 1, the fixed center cylinder 34 includes a radial slot 106 receiving a biasing means, such as a spring 108, and an inner vane 110 which separates the inner pocket 102 into a discharge pressure section 112 and a suction pressure section 114. Also included on the top of the fixed center cylinder member 34 is an inner discharge port 116. On the opposite side of where inner vane 110 seals against the orbiting piston member 58 is an outer vane 118. Outer vane 118 is disposed within a radial slot 120 in the fixed outer cylinder member 36 and biased toward the orbiting piston member 58 by means of a spring 122. Outer vane 118 separates outer pocket 104 into a discharge pressure section 124 and a suction pressure section 126. Received in the fixed outer cylinder member 36 next to the outer vane 118 is an outer discharge port 128.

Figure 4:
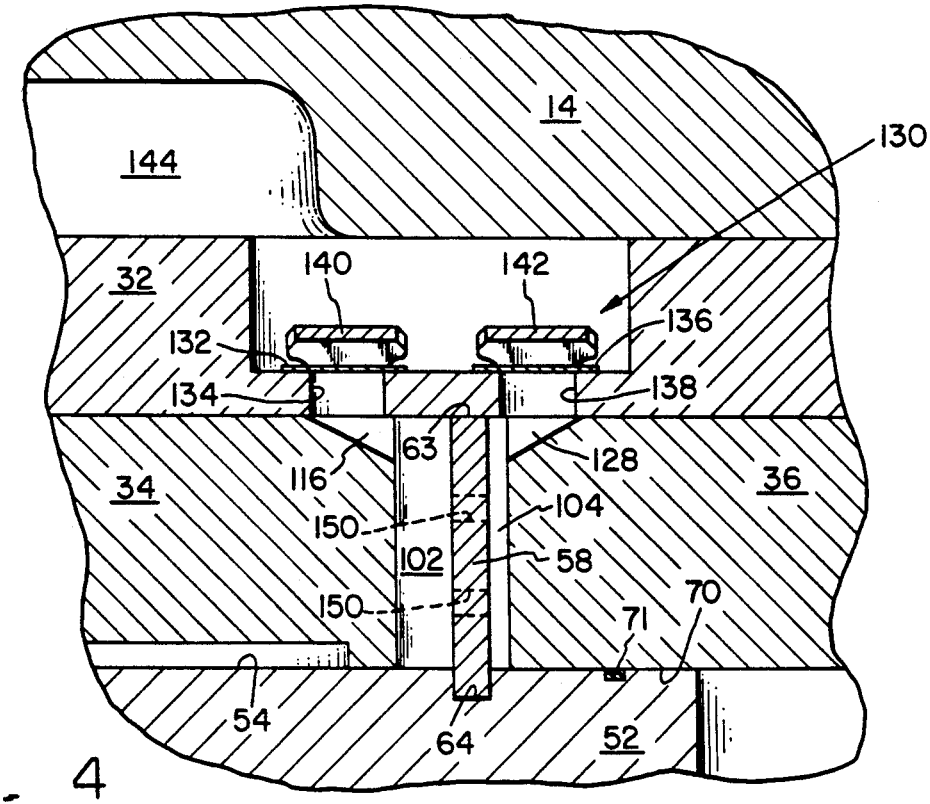
FIG. 4 is an enlarged fragmentary cross-sectional view of the discharge valve area of the compressor.
Figure 2:
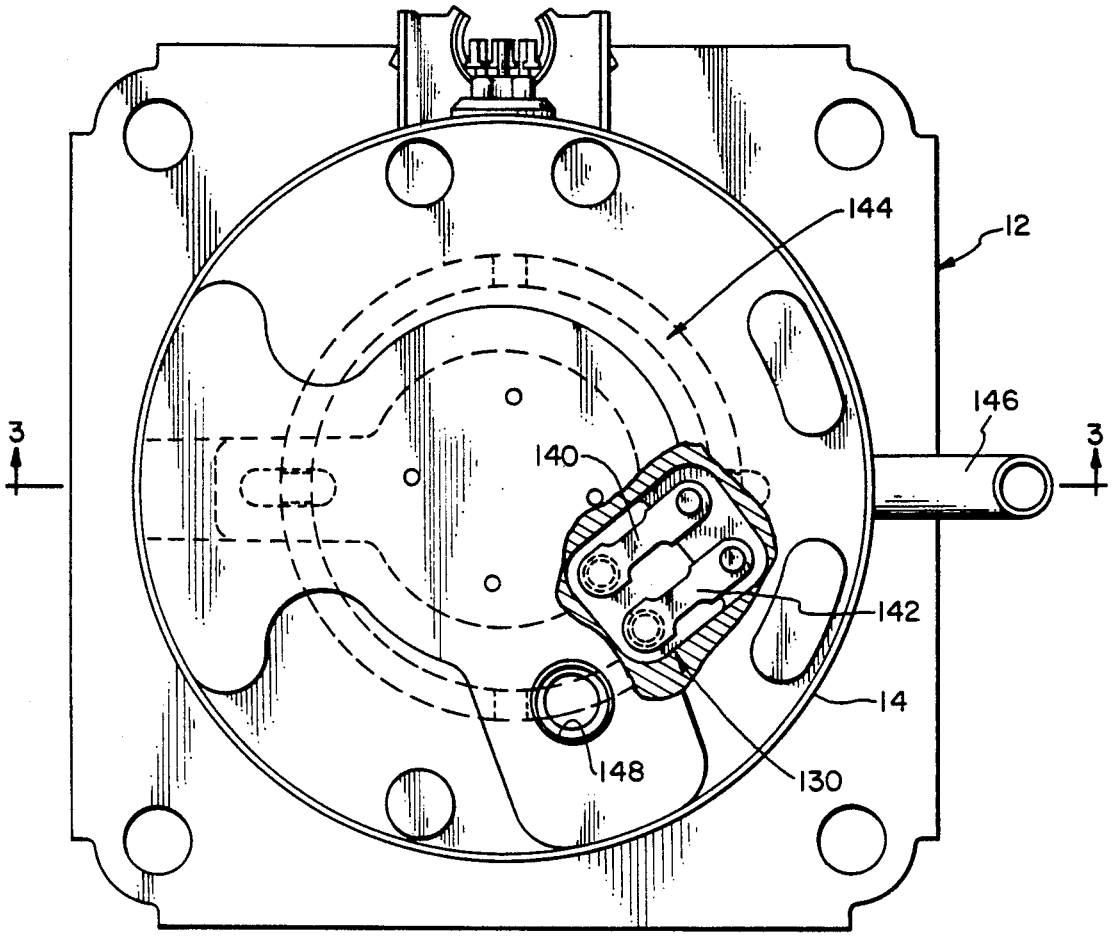
FIG. 2 is a partially sectioned top view of the compressor of the present invention, particularly showing the discharge valve assembly.

Now referring to FIGS. 2 and 4, above the inner and outer discharge ports 116 and 128, is a discharge valve assembly 130 consisting of an inner discharge valve 132 over inner discharge passageway 134 and inner discharge port 116, and an outer discharge valve 136 over outer discharge passageway 138 and outer discharge port 128. Valve retainers 140 and 142 are connected to the top housing 14 over both discharge valves to prevent overflexing of valves 132 and 136. A discharge chamber 144 is provided above discharge valve assembly 130 to allow refrigerant at discharge pressure to flow away from valve assembly 130 and into the compressor housing 12. From the housing 12, compressed fluid may exit through discharge tube 146, (FIG. 3) to the condenser of refrigeration system (not shown). Through top housing 14 is a suction intake port 148 communicating with outer fluid pocket 104. The annular orbiting piston member 58 has a plurality of openings 150 through which refrigerant at suction pressure may flow to inner pocket 114.

The operation of the compressor, as indicated in the embodiment in FIG. 1, occurs as the compressor motor (not shown), rotates crankshaft 20. Crankshaft 20 and crank mechanism 82 cause the orbiting plate 52 to rotate. The Oldham ring 72 between the orbiting plate 52 and main bearing member 30 prevent rotation and instead cause the orbiting plate 52 to orbit. The annular orbiting piston member 58 orbits within the space between the fixed center cylinder member 34 and fixed outer cylinder member 36.

The orbiting of the annular orbiting piston member 58 causes both the inner vane 110 and outer vane 118 to move radially within their radial slots 106 and 120. Since the vanes are shorter than the radial slots 106 and 120 and are biased toward the orbiting piston 58 by springs 108 and 122, the vanes seal against the orbiting piston 58. The movement of piston member 58, inner vane 110 and outer vane 118, create pockets of changing volume when the orbiting piston 58 orbits.

Refrigerant is drawn first into outer pocket 104 by direct suction through suction inlet port 148. Since inner pocket 114 is connected through openings 150 to outer pocket 104, refrigerant also is suctioned into inner pocket 114. As the orbiting piston 58 orbits, the point of contact with the fixed annular cylinder member wall 46 moves past the suction inlet 152. This effectively creates at least one substantially closed chamber 154. As the piston 58 continues to orbit the chamber 154 moves in front of the point of contact and contracts in size due to the geometry of the orbiting piston 58, inner wall 46 and moving inner and outer vanes 110 and 118. The compressed fluid is expelled through the discharge valves 132 and 136 on each side of the orbiting piston 58. Compressed fluid at discharge pressure can now fill the discharge chamber 144, compressor housing 12, and exit though discharge tube 146. The compressor 10 and housing 12 are designed to be at substantially discharge pressure during operation.

Radial compliance of the orbiting piston 58 is accomplished by means of the swing-link assembly on the crank mechanism 92. The mechanism 92 forces the orbiting piston 58 to seal in the radial direction against the inner wall 46 of the fixed outer cylinder member 36. Upon compressor operation the cylindrical roller 94 upon pin 95 and crankpin 96 is thrown radially outward, thereby pressing orbiting piston 58 radially outward.

The axial compliance of the orbiting piston 58 occurs as the compressor begins operation. Discharge pressure on drive surface 56, and suction pressure on mounting surface 54 force orbiting plate 52 axially upward toward top member 32. Annular orbiting piston member 58 attached to orbiting plate 52 is also forced axially upward, causing end face 63 to sealingly engage with end wall 33 of top member 32. Discharge pressure behind orbiting plate 52 causes sealing between inner pocket 102 and outer pocket 104 at the point where end face 63 meets end wall 33. Outer pocket 104 is separated from the discharge pressure of compressor housing 12 by means of annular seal 71 an annular seal 86.

Figure 8:
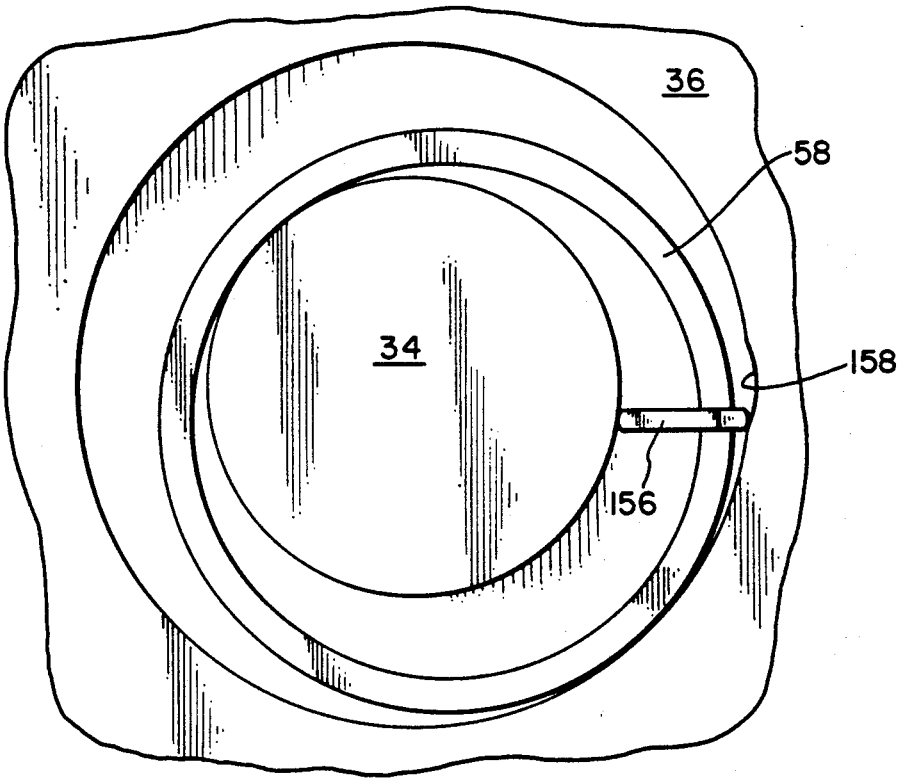
FIG. 8 is a cross-sectional view of an alternative embodiment of the present invention featuring a single vane.

An alternative embodiment, as shown in FIG. 8, comprises fixed center cylinder member 34 and fixed outer cylinder member 36 separated by an annular orbiting piston member 58. The piston member is driven by the same mechanism as the previous embodiment. In this embodiment, a single vane 156 is slidingly disposed through the annular orbiting piston member 58 sealing against the annular orbiting piston member 58, fixed center cylinder member 34 and fixed outer cylinder member 36. In this embodiment, the single vane 156 slides back and forth in the annular orbiting piston member 58 while the annular orbiting piston member 58 orbits.

The distance between the fixed center cylinder member 34 and the fixed outer cylinder member is not constant. The area 158 were the single vane 158 sliding seals against the fixed outer cylinder member 36 has a different radius to prevent the vane 156 from seizing against the fixed outer cylinder member 36 as it tilts back and forth during compressor operation. Specifically the area 158 has the same radius as the fixed center cylinder member 34 so the distance between the cylinders is constant for a distance equal to the stroke of the compressor. The length of the vane 156 is equal to the distance between the two cylinder members 34 and 36 at area 158.

Figure 9:
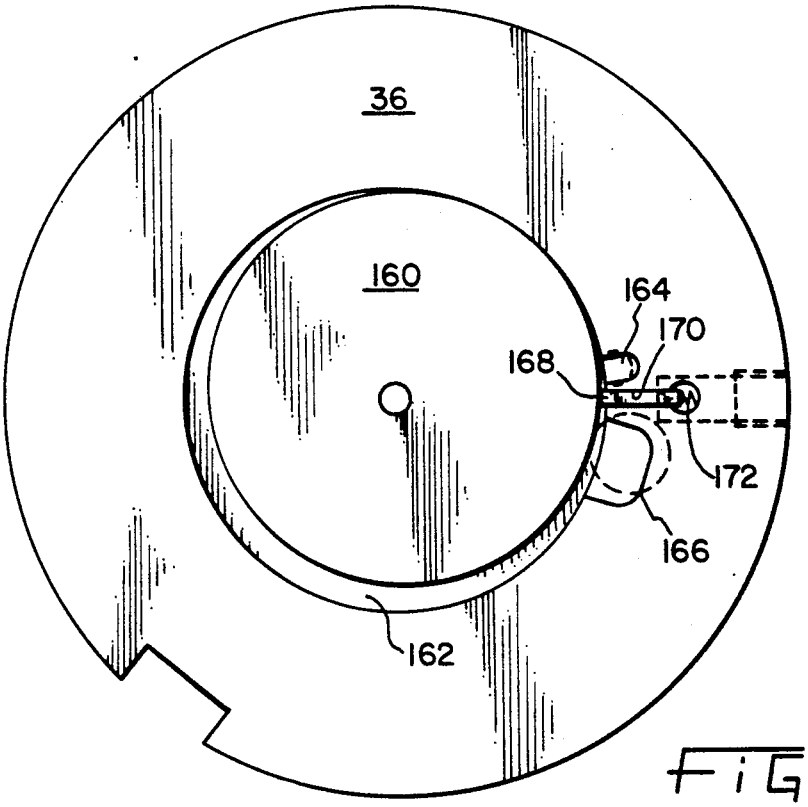
FIG. 9 is an enlarged cross-sectional view of an alternative embodiment of the present invention featuring a single orbiting piston.

In the alternative embodiment of FIG. 9, there is a fixed outer cylinder member 36 and a cylindrical orbiting piston 160 received in a larger cylindrical void 162 in the fixed outer cylinder member 36. A discharge port 164 and an intake port 166 separated by a single vane 168. The single vane 168 is slidingly disposed within a radial slot 170 and biased toward the orbiting piston 160 by means of a spring 172. Piston member 160 is driven by the same mechanism as is the previous embodiment.

It will be appreciated that the foregoing description of various embodiments of the invention is presented by way of illustration only and not by way of any limitation, and that various alternatives and modifications may be made to the illustrated embodiment without departing from the spirit and scope of the invention.

What is claimed is:

1. A compressor for compressing refrigerant fluid comprising:

a cylinder having a side wall and an end wall defining a chamber;

a cylindrical piston, said piston having an end face, and a cylindrical side wall, said piston disposed in said chamber;

drive means including an Oldham ring for causing said piston to orbit in said chamber in a manner such that said piston sidewall orbitally contacts said cylinder sidewall;

axial compliance means for yieldably pressing said end face of said piston against said end wall of said cylinder to form a seal; and radial compliance means for yieldably pressing said side wall of said piston against said side wall of said cylinder to form a seal.

2. The compressor of claim 1 in which said drive means includes said Oldham ring with two pairs of oppositely facing tabs preventing rotation of said cylindrical piston.

3. The compressor of claim 1 in which said axial compliance means includes a compressor section at substantially discharge pressure, in communication with a back side of said piston and another compressor section at substantially suction pressure in communication with a front side of said piston, to force said end face into sealing contact with said end wall of said cylinder wall together.

4. The compressor of claim 1 in which said radial compliance means includes a swing-link means attached to said piston and said drive means for forcing said piston wall toward said cylinder side wall for sealing during compressor operation.

5. The compressor of claim 1 in which said compressor includes at least one vane sealing between portions of suction pressure and discharge pressure between said piston member and said cylinder.

6. The compressor of claim 1 in which said cylindrical piston includes an generally flat orbiting plate having a mounting surface and a drive surface, an annular piston member attached to said mounting surface with said end face oriented away from said mounting surface, said drive surface connected to said drive means.

7. The compressor of claim 6 in which said compressor includes at least one vane sealing between portions of suction pressure and discharge pressure between said orbiting piston member and said cylinder side wall and sealing between said orbiting piston member and a fixed center cylinder member, attached to said cylinder end wall.

8. A compressor for compressing refrigerant fluid comprising:

a cylinder having a side wall and an end wall defining a chamber;

a cylindrical piston, said piston having an end face, and a cylindrical side wall, said piston disposed in said chamber;

drive means for causing orbiting motion of said piston in said chamber in a manner such that said piston nonslidingly contacts said cylinder sidewall, said drive means including an Oldham ring with two pairs of oppositely facing tabs preventing rotation of said cylindrical piston;

axial compliance means for yieldably pressing said end face of said piston against said end wall of said cylinder to form a seal; and radial compliance means for yieldably pressing said side wall of said piston against said side wall of said cylinder to form a seal.

9. The compressor of claim 8 in which said axial compliance means includes a compressor section at substantially discharge pressure, in communication with a back side of said piston and another compressor section at substantially suction pressure in communication with a front side of said piston, to force said end face into sealing contact with said end wall of said cylinder wall together.

10. The compressor of claim 8 in which said radial compliance means includes a swing-link means attached to said piston and said drive means for forcing said piston wall toward said cylinder side wall for sealing during compressor operation.

11. The compressor of claim 8 in which said compressor includes at least one vane sealing between portions of suction pressure and discharge pressure between said piston member and said cylinder.

12. The compressor of claim 8 in which said cylindrical piston includes an generally flat orbiting plate having a mounting surface and a drive surface, an annular piston member attached to said mounting surface with said end face oriented away from said mounting surface, said drive surface connected to said drive means.

13. The compressor of claim 12 in which said compressor includes at least one vane sealing between portions of suction pressure and discharge pressure between said orbiting piston member and said cylinder side wall and sealing between said orbiting piston member and a fixed center cylinder member, attached to said cylinder end wall.

14. The compressor of claim 13 in which said compressor includes an inner vane and outer vane, where said inner vane seals between the radially inward wall of said orbiting piston and said fixed center cylinder, said outer vane sealing between radially outward wall of said orbiting piston and said cylinder.

15. The compressor of claim 14 in which said fixed center cylinder has a radial slot retaining said inner vane and a biasing means for effective sealing of said inner vane against said fixed center cylinder and said orbiting piston.

16. The compressor of claim 14 in which said cylinder has a radial slot retaining said outer vane and a biasing means for effective sealing of said outer vane against said cylinder side walls and said orbiting piston.

17. The compressor of claim 14 including passage means for allowing fluid at suction pressure to enter said outer pocket and said inner pocket.

18. The compressor of claim 14 wherein said orbiting piston has at least one opening through which fluid at suction pressure in one said pocket may communicate with the other pocket.

19. The compressor of claim 14 in which said orbiting piston has a plurality of openings through which fluid in said outer pocket can communicate with said inner pocket.

20. The compressor of claim 19 in which said drive means includes an Oldham ring with two pairs of oppositely facing tabs preventing rotation of said cylindrical piston.

21. An orbiting rotary-type compressor for compressing refrigerant fluid, comprising:

a hermetically sealed housing having disposed therein a discharge pressure chamber at discharge pressure and a suction pressure chamber at suction pressure;

a fixed cylinder housing having a chamber, said cylinder chamber having a side wall and an end wall;

a fixed center cylinder member within said chamber;

an orbiting annular cylindrical piston between said fixed cylinder housing and said fixed center cylinder in said chamber, creating an inner pocket and an outer pocket;

drive means for orbiting said orbiting piston between said fixed cylinder housing and said fixed center cylinder to expand and contract said inner and outer pockets, said drive means causing said orbiting piston to nonslidingly contact said fixed cylinder housing and said fixed center cylinder;

axial compliance means for yieldably pressing said piston against said end wall of said cylinder housing to form a seal;

radial compliance means for yieldably pressing said piston against said side wall of said cylinder housing to form a seal; and an inner vane and an outer vane, at least one vane sealing between suction pressure portions and discharge pressure portions of said inner pocket and said outer pocket, where said inner vane seals between a radially inward wall of said orbiting piston and said fixed center cylinder member, said outer vane sealing between a radially outward wall of said orbiting piston and said fixed cylinder housing.

22. The compressor of claim 21 in which said fixed center cylinder has a radial slot retaining said inner vane and a biasing means for effective sealing of said inner vane against said fixed center cylinder and said orbiting piston.

23. The compressor of claim 21 in which said fixed cylinder housing has a radial slot retaining said outer vane and a biasing means for effective sealing of said outer vane against said fixed cylinder housing and said orbiting piston.

24. The compressor of claim 21 in which said orbiting piston has a plurality of openings through which fluid in said outer pocket can communicate with said inner pocket.

* * * * *